US009936783B2

(12) United States Patent
Harris

(10) Patent No.: US 9,936,783 B2
(45) Date of Patent: Apr. 10, 2018

(54) METHOD AND DEVICE FOR STRAIGHTENING HAIR

(71) Applicant: Harold Harris, Atlanta, GA (US)

(72) Inventor: Harold Harris, Atlanta, GA (US)

( * ) Notice: Subject to any disclaimer, the term of this patent is extended or adjusted under 35 U.S.C. 154(b) by 97 days.

(21) Appl. No.: 14/995,841

(22) Filed: Jan. 14, 2016

(65) Prior Publication Data

US 2016/0213118 A1 Jul. 28, 2016

Related U.S. Application Data

(60) Provisional application No. 62/106,716, filed on Jan. 23, 2015.

(51) Int. Cl.

| | |
|---|---|
| ***A45D 19/18*** | (2006.01) |
| ***A45D 2/00*** | (2006.01) |
| ***A45D 2/38*** | (2006.01) |

(52) U.S. Cl.

CPC ..... *A45D 2/001* (2013.01); *A45D 2/38* (2013.01)

(58) Field of Classification Search

CPC ..... A45D 7/045; A45D 2/38; A45D 2/001; A45D 2002/008; A45D 2002/38

USPC ..... 132/270

See application file for complete search history.

(56) References Cited

U.S. PATENT DOCUMENTS

| | | | | |
|---|---|---|---|---|
| 2,526,581 | A | 10/1950 | Roth | |
| 3,419,017 | A | 12/1968 | Steek et al. | |
| 4,503,870 | A * | 3/1985 | Peterson | A45D 7/04 132/270 |
| 5,299,367 | A | 4/1994 | Johnson et al. | |
| 6,622,735 | B2 | 9/2003 | Hirata et al. | |
| 8,251,073 | B2 | 8/2012 | Sparacia et al. | |
| 2008/0072921 | A1 | 3/2008 | Habibi | |
| 2014/0076351 | A1 * | 3/2014 | Debenedictis | A45D 2/00 132/223 |
| 2014/0166037 | A1 | 6/2014 | Renfro | |

* cited by examiner

*Primary Examiner* — Todd E Manahan
*Assistant Examiner* — Brianne Kalach
(74) *Attorney, Agent, or Firm* — PatentFile, LLC; Bradley C. Fach; Steven R. Kick

(57) ABSTRACT

A hair straightening device which in some embodiments may include an applicator and a hair press. The applicator may have a shaft with a handle and a hair hook. The hair press may have a first press member, a second hair press member, a first hinge assembly, and a cavity. The first press member may include a first press surface, a first elongated locking side, and a first elongated hinge side. The second press member may include a second press surface, a second elongated locking side, and a second elongated hinge side. The first hinge assembly may be configured to pivotally couple the first elongated hinge side of the first press member to the second elongated hinge side of the second press member. The cavity may be formed between the first press surface and second press surface when the press surfaces are moved proximate to each other.

18 Claims, 8 Drawing Sheets

METHOD AND DEVICE FOR STRAIGHTENING HAIR

CROSS REFERENCE TO RELATED APPLICATIONS

This application claims priority to and the benefit of the filing date of U.S. Provisional Application No. 62/106,716, filed on Jan. 23, 2015, entitled "METHOD AND DEVICE FOR STRAIGHTENING HAIR", which is hereby incorporated by reference in its entirety.

FIELD OF THE INVENTION

This patent specification relates to the field of hair styling. More specifically, this patent specification relates to devices and methods for straightening hair.

BACKGROUND

Many people with naturally wavy, curly or kinky hair, have the desire to temporarily straighten their hair and/or remove their natural wavy, curly or kinky hair patterns temporarily. There are several devices and methods used to straighten non-straight hair, including, but not limited to, using a flat iron, blow drying the hair using a brush or comb, and/or using chemical solutions. Each of the above mentioned methods and devices has, however, less than desirable aspects that can cause damage to healthy hair.

Many people are very conscious about adding excessive heat and/or harsh chemicals to their hair for fear of causing irreparable damage to their otherwise healthy hair. The flat iron, for example, is heated to a very high temperature and can cause heat damage to otherwise healthy hair which makes its use less than ideal. Similarly, using a blow-dryer with a brush or comb combination to straighten the hair also generates a significant amount of heat, that can cause heat damage to otherwise healthy hair. The chemical solutions are often toxic and can greatly damage the hair, as well as the scalp.

Presently there are methods and devices available to straighten hair without the use of heat or harsh chemicals. However, these methods and devices do not work as well on all hair types. Particularly, kinky hair or hair with very tight curl patterns. These particular hair types tend to start reforming their normal curl patterns while being placed in the current available devices. The end results are not the most desirable.

Therefore, a need exists for novel devices and methods for straightening hair. There is a further need for improved methods and devices for straightening hair without heat, to compensate for inadequacies in existing technologies. Finally, there exists a need for improved methods and devices for straightening hair without harsh chemicals to which cause irreparable damage to their otherwise healthy hair.

BRIEF SUMMARY OF THE INVENTION

A hair straightening device is provided. In some embodiments, the device may include an applicator and a hair press. The applicator may have a shaft with a first end and a second end. A handle may be coupled to the first end and a hair hook may be coupled to the second end. The hair press may have a first press member, a second hair press member, a first hinge assembly, and a cavity. The first press member may include a first press surface, a first elongated locking side, and a first elongated hinge side. The second press member may include a second press surface, a second elongated locking side, and a second elongated hinge side. The first hinge assembly may be configured to pivotally couple the first elongated hinge side of the first press member to the second elongated hinge side of the second press member. The cavity may be configured to slidably receive the shaft and hair hook, and the cavity may be formed between the first press surface and second press surface when the press surfaces are moved proximate to each other. The applicator may be positioned within the cavity and the hair hook may be used to entrap one or more strands of hair. By pulling the applicator through the cavity, the hair strand may be pulled or manipulated into the cavity in a generally straightened orientation. Once the desired hair is in the cavity, the hair hook may be disengaged from the hair. While in the cavity, the hair, such as wet or damp hair, may be compressed between the first press surface and the second press surface allowing the hair to optionally dry and remain in a straightened orientation after the hair press is removed from the hair.

In further embodiments, the hair press may further include a second hinge assembly configured to pivotally couple the first elongated locking side of the first press member to the second elongated locking side of the second press member. Preferably, both the first hinge assembly and the second hinge assembly may comprise a living hinge.

In still further embodiments, a hair straightening device may include an applicator and a hair press. The applicator may have a shaft with a first end and a second end. A handle may be coupled to the first end and a hair hook may be coupled to the second end. The hair press may have a first press member, a second hair press member, a first hinge assembly, a locking assembly, and a cavity. The first press member may include a first press surface, a first elongated locking side, and a first elongated hinge side. The second press member may include a second press surface, a second elongated locking side, and a second elongated hinge side. The first hinge assembly may be configured to pivotally couple the first elongated hinge side of the first press member to the second elongated hinge side of the second press member. The locking assembly may be configured to removably couple the first elongated locking side to the second elongated locking side. The cavity may be configured to slidably receive the shaft and hair hook, and the cavity may be formed between the first press surface and second press surface when the first elongated locking side is removably coupled to the second elongated locking side.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
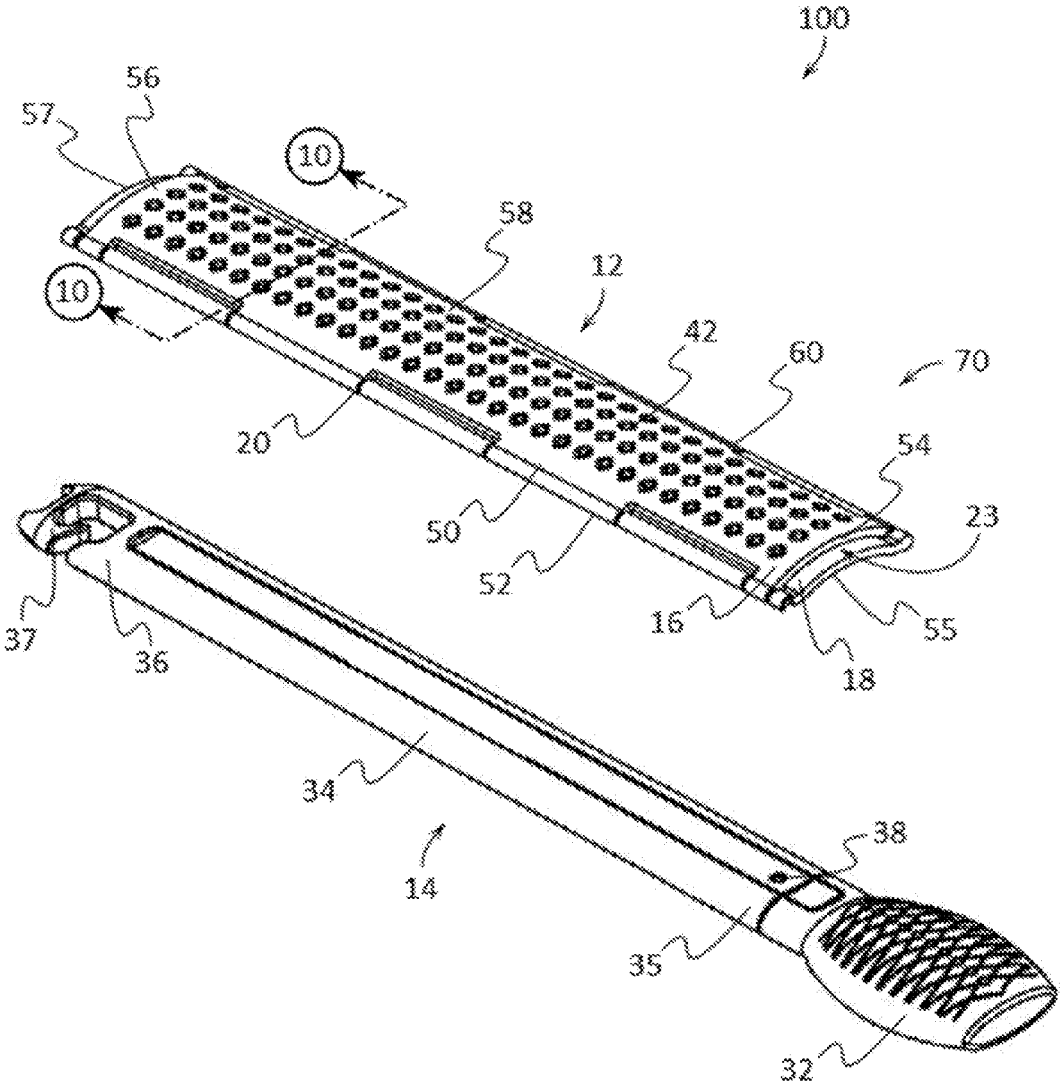
FIG. 1 depicts a top perspective view of an example of a hair straightening device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

New hair styling devices and methods are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 2:
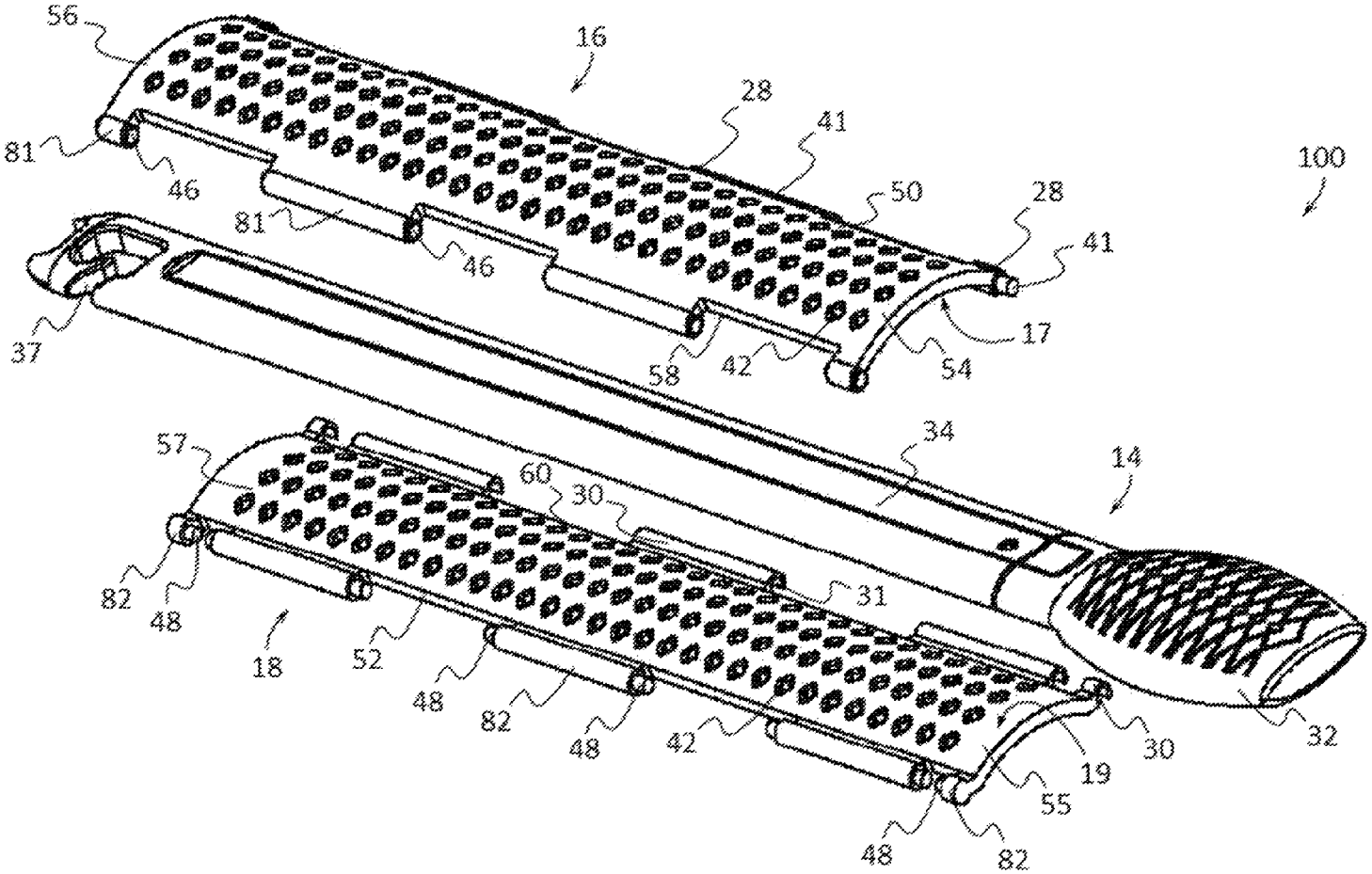
FIG. 2 illustrates a perspective exploded view of an example of a hair straightening device according to various embodiments described herein.
Figure 3:
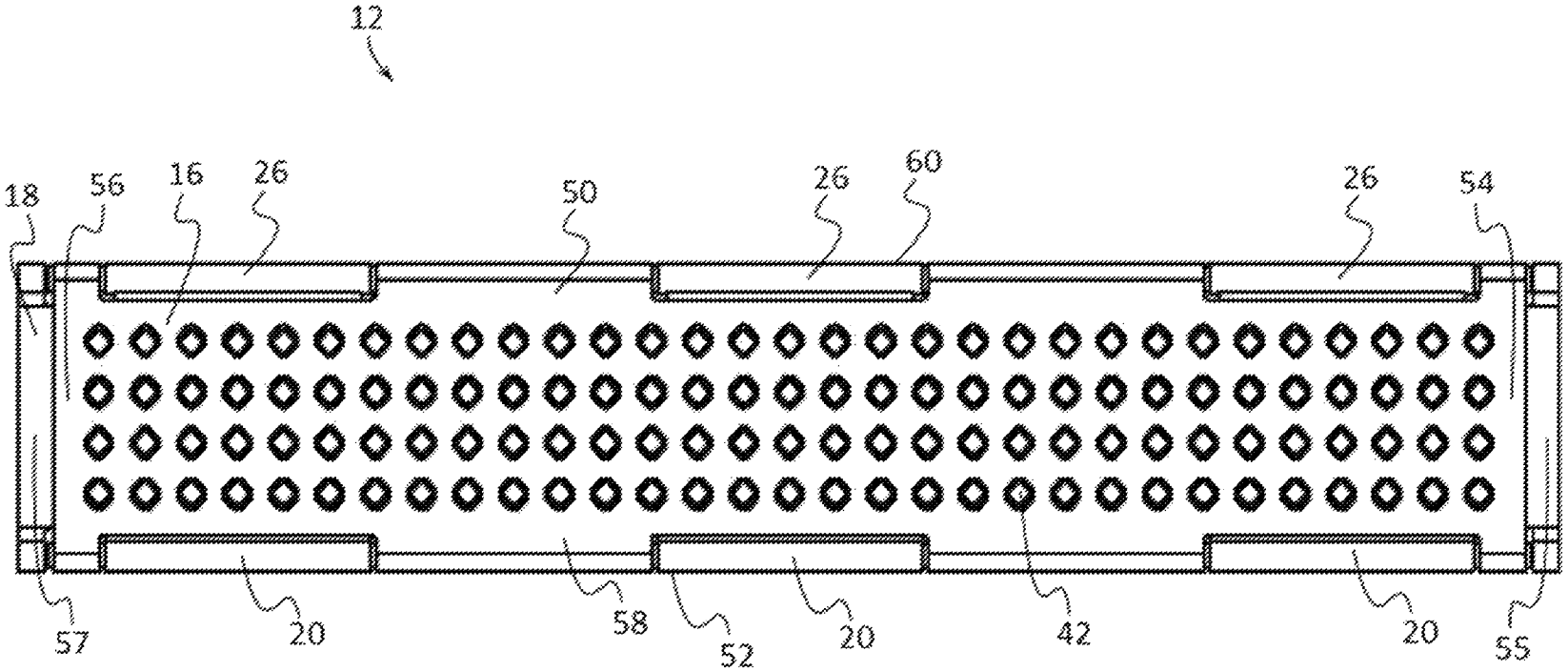
FIG. 3 shows a plan view of an example of a hair press of a hair straightening device according to various embodiments described herein.
Figure 4:
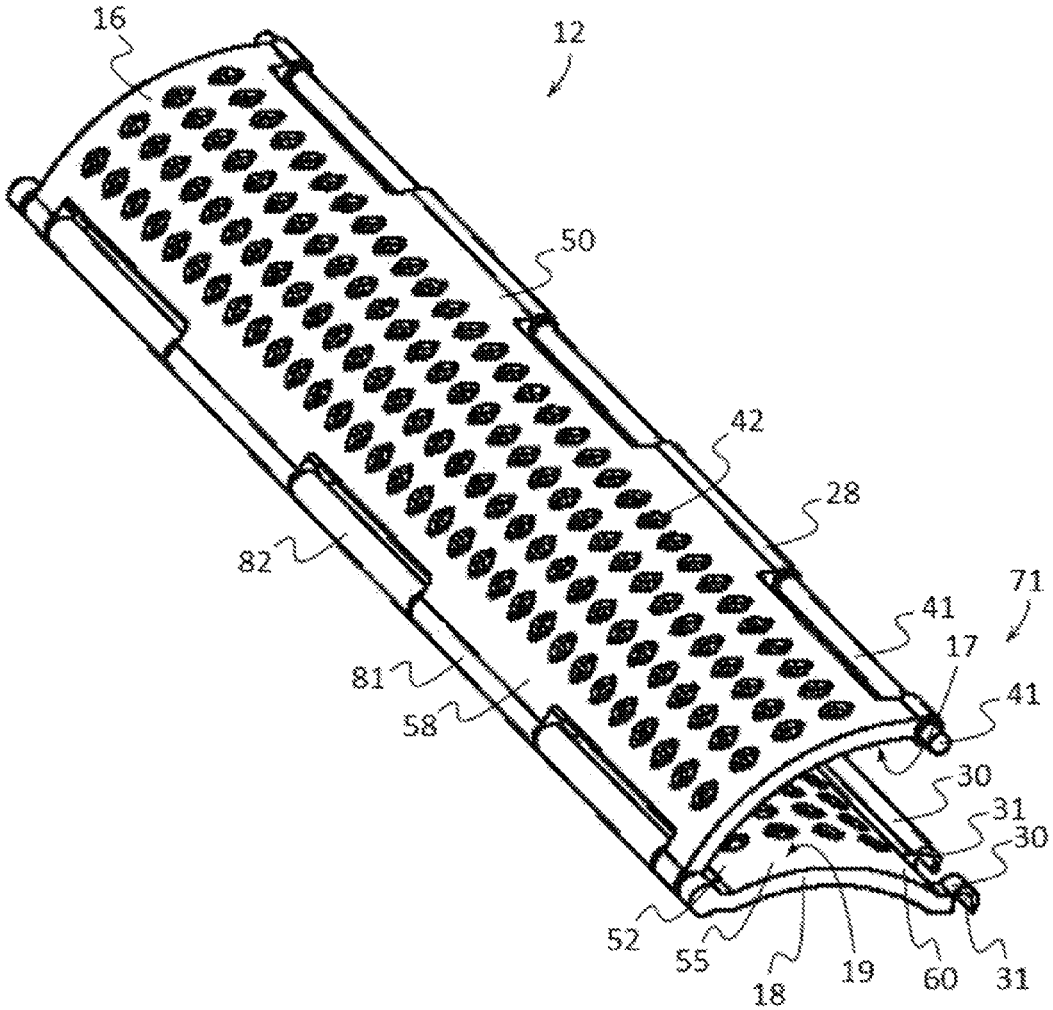
FIG. 4 depicts a perspective view of an example of a hair press of a hair straightening device according to various embodiments described herein
Figure 5:
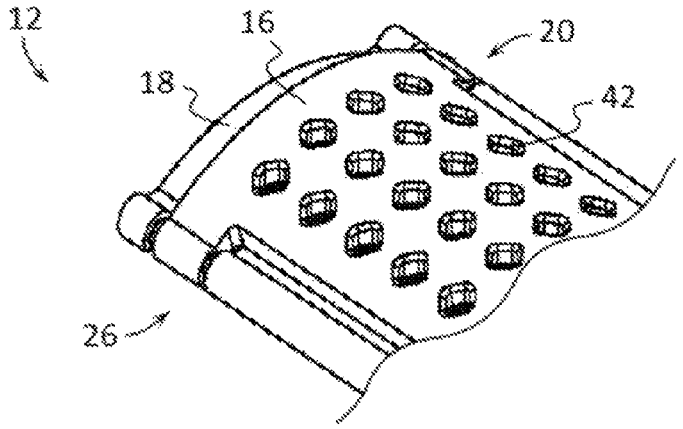
FIG. 5 illustrates a partial perspective view of an example of a hair press in a closed position according to various embodiments described herein.
Figure 6:
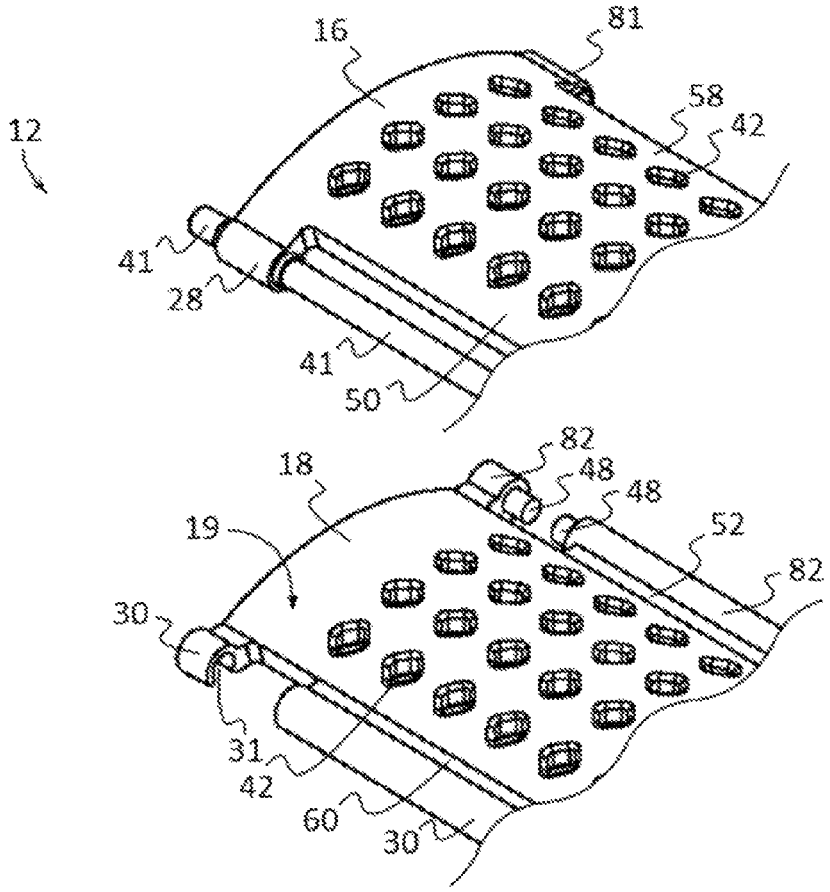
FIG. 6 shows a perspective view of an example of a hair press in an open position according to various embodiments described herein.

The present invention will now be described by example and through referencing the appended figures representing preferred and alternative embodiments. FIGS. 1 and 2 illustrate an example of a hair straightening device ("the device") 100 according to various embodiments. In this example, the device 100 comprises an applicator 14 and a hair press 12. The applicator 14 may include a shaft 34 with a first end 36 and a second end 37. A handle 32 may be coupled to the first end 35 of the shaft 34, and a hair hook 37 may be coupled to the second end 37 of the shaft 14. The hair press 12 may comprise a first press member 16 and a second press member 18. The first press member 16 may include a first press surface 17 (FIGS. 4 and 11), a first elongated locking side 50, and a first elongated hinge side 58. The second press member 18 may include a second press surface 19 (FIGS. 4 and 11), a second elongated locking side 60, and a second elongated hinge side 52. The hair press 12 may further include a locking assembly 26 configured to removably couple the first elongated locking side 50 to the second elongated locking side 60 and a hinge assembly 20 configured to pivotally couple the first elongated hinge side 58 to the second elongated hinge side 52. A cavity 23 (FIG. 11) may be formed between the first press surface 17 and second press surface 19 when the first press member 16 is moved proximate to the second press member 18, thereby moving the two press surfaces 17, 19, proximate to each other.

In some embodiments, and as shown in FIGS. 1-4, 8, and 9, the first press member 16 and second press member 18 may be configured with a generally rectangular shape, such that the first press member 16 may comprise two elongated sides 50, 58, and two shorter sides such as a first proximal minor side 54 and a first distal minor side 56. The second press member 18 may comprise two elongated sides 52, 60, and two shorter sides such as a second proximal minor side 55 and a second distal minor side 57. In alternative embodiments, the first press member 16 and second press member 18 may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

In preferred embodiments, the first press member 16 may comprise a first press surface 17 and the second press member 18 may comprise a second press surface 19. The hair press 12 may be moved into a closed position 70 (FIGS. 1, 3, 5, 6, 8-11) by pivoting the press members 16, 18, at the hinge assembly 20 until the press surfaces 17, 19, are proximate to each other and the locking assembly 26 may removably couple the press members 16, 18, together. The hair press 12 may be moved into an open position 71 (FIG. 4) by uncoupling the locking assembly 26 and pivoting the press surfaces 17, 19, away from each other at the hinge assembly 20.

Figure 10:
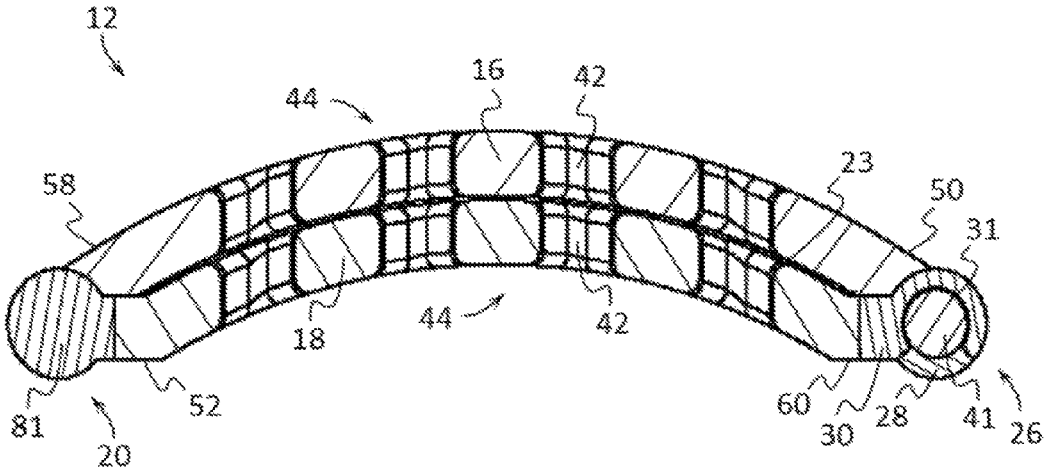
FIG. 10 depicts a sectional, through line 10-10 shown in FIG. 1, elevation view of an example of a hair press according to various embodiments described herein.
Figure 11:
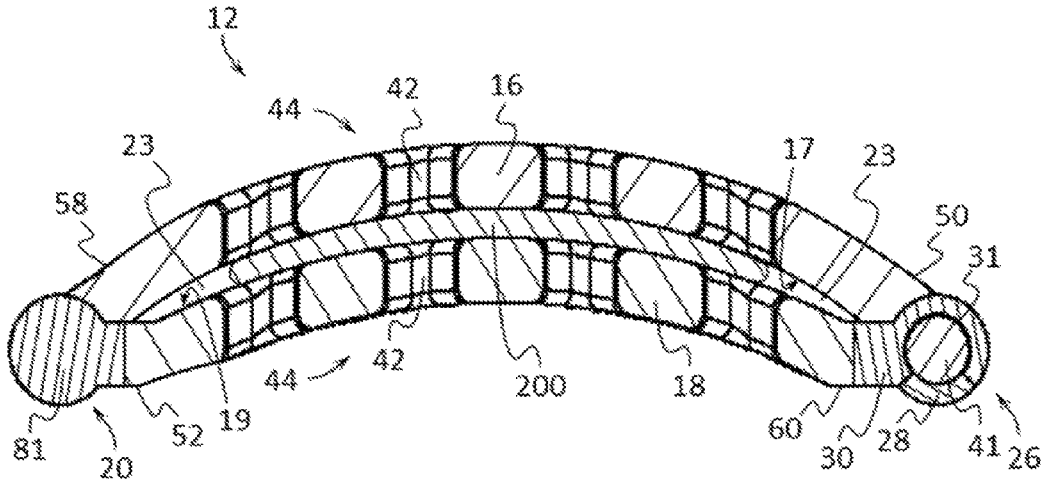
FIG. 11 illustrates a sectional, through line 11-11 shown in FIG. 9, elevation view of an example of a hair press engaged to hair according to various embodiments described herein.

In some embodiments, the first press surface 17 of the first press member 16 and/or the second press surface 19 of the second press member 18 may comprise a curved planar shape 44 as perhaps best shown in the cross sections of FIGS. 10 and 11. In some embodiments, the first press surface 17 and/or the first press member 16 may be made from a resilient or flexible material and the second press surface 19 and/or the second press member 18 may be made from a generally rigid material and comprise an curved planar shape 44. When the hair press 12 is moved into the closed position 70, the first press surface 17 and/or the first press member 16 may flex into a curved planar shape that is complementary to the curved planar shape 44 of the rigid second press surface 19 and/or the second press member 18. In alternative embodiments, the second press surface 19 and/or the second press member 18 may be made from a resilient or flexible material and the first press surface 17 and/or the first press member 16 may be made from a generally rigid material and comprise an curved planar shape 44. When the hair press 12 is moved into the closed position 70, the second press surface 19 and/or the second press member 18 may flex into a curved planar shape that is complementary to the curved planar shape 44 of the rigid first press surface 17 and/or the first press member 16. By comprising a resilient or flexible material, when the hair press 12 is moved into a closed position 70, elements within the cavity 23 formed between the press surfaces 17, 19, such as hair 200 and portions of the applicator 14 may be compressed between the press surfaces 17, 19.

In some embodiments, a generally rigid material may comprise a substantially rigid material such as polytetrafluoroethylene (PTFE), polyethylene terephthalate (PET), high-density polyethylene (HDPE), polyvinyl chloride (PVC), polypropylene (PP), Polystyrene (PS), Polycarbonate (PC), low density polyethylene (LDPE), Polyoxymethylene (POM), Acrylonitrile butadiene styrene (ABS), Polyethylene/Acrylonitrile Butadiene Styrene (PE/ABS), Polycarbonate/Acrylonitrile Butadiene Styrene (PC/ABS), Ultra High Molecular Weight polyethylene, Polyurethanes (PU), Polyamides (PA), other substantially rigid plastics, hard rubbers, resins, ceramics, wood, carbon fiber, glass, metals and metal alloys, or any other suitable flexible natural or synthetic material including combinations of materials. In some embodiments, a resilient or flexible material may comprise an elastic polymer such as Ethylene-vinyl acetate (EVA), ethylene propylene rubber (EPM), ethylene propylene diene rubber (EPDM), Epichlorohydrin rubber (ECO), Polyacrylic rubber (ACM, ABR), Silicone rubber (SI, Q, VMQ), various types of flexible plastics such as polyvinyl chloride, natural or synthetic rubber, synthetic fabrics such as polyester, acrylic, nylon, rayon, acetate, spandex, lastex, and Kevlar, and natural fabrics such as coir, cotton, hemp, jute, canvas, flax, leather, linen, ramie, wool, silk, or any other suitable flexible natural or synthetic material including combinations of materials.

In some embodiments and as shown in FIGS. 2-6, the press members 16, 18, may be pivotally coupled together by a hinge assembly 20 which is configured to pivotally couple the first elongated hinge side 58 of the first press member 16 to the second elongated hinge side 52 of the second press member 18. The hinge assembly 20 may comprise a first hinge element 81 with a female aperture 46 on the first elongated hinge side 58, and the hinge assembly 20 may also comprise a second hinge element 82 with a male pin 48 on the second elongated hinge side 52. The male pin 48 may be inserted into the female aperture 46 and configured to pivot or rotate within the female aperture 46 thereby forming a pivotal coupling. In further embodiments, the hinge assembly 20 may comprise a living hinge which may comprise a linear, relatively flexible area between two relatively more rigid components, such as a line of thin plastic between thicker plastic portions, as is well known in the art. In alternative embodiments, a hinge assembly 20 may comprise a piano hinge which may be formed with one or more portions of a first elongated hinge side 58 which are configured to interlock with one or more portions of a second elongated hinge side 52 thereby forming a bearing which connects the first press member 16 to the second press member 18 that is configured to allow the first elongated locking side 50 to be pivoted towards and away from the second elongated locking side 60. In other embodiments, a hinge assembly 20 may comprise a butt hinge, barrel hinge, butt/Mortise hinge, case hinge, flag hinge, strap hinge, H hinge, HL hinge, piano hinge, butterfly hinge, flush hinge, barrel hinge, concealed hinge, continuous hinge, T-hinge, strap hinge, double-acting hinge, Soss hinge, counterflap hinge, flush hinge, coach hinge, rising butt hinge, double action spring hinge, tee hinge, friction hinge, security hinge, cranked hinge or stormproof hinge, lift-off hinge, self closing or self positioning hinge, flexible material hinge, or any other type or style of hinge suitable for pivotally joining the first press member 16 to the second press member 18.

In some exemplary embodiments, a hinge assembly 20 may be formed by one or more female apertures 46, on the first elongated hinge side 58 of the first press member 16 and one or more male pins 48, on the second elongated hinge side 52 of the second press member 18. Portions of the male pins 48 may be received and configured to rotate or pivot within the female apertures 46 thereby allowing the press members 16, 18, to be pivotally coupled together by the hinge assembly 20. In further embodiments, a hinge assembly 20 may comprise a male pin 48 that may be received by both a first female aperture 46 at a first end of the hinge assembly 20, such as proximate to a first minor side 54, 56, and a second female aperture 46 at a second end of the hinge assembly 20, such as proximate to a second minor side 55, 57. The male pin 48 may extend between the two opposing female apertures 46, thereby extending substantially the length of the hinge assembly 20, and be configured to pivot within the female apertures 46.

In some embodiments and as shown in FIGS. 2-6, the press members 16, 18, may be removably coupled together by a locking assembly 26 which is configured to removably couple the first elongated locking side 50 of the first press member 16 to the second elongated locking side 60 of the second press member 18. In further embodiments, a locking assembly 26 may comprise one or more first locking mechanism elements 28 and one or more second locking mechanism elements 30 with each second locking mechanism element 30 having a channel 31 and with each first locking element 28 having a bar 41. A first locking mechanism element 28 and a second locking mechanism element 30 may be configured to be removably coupled together by inserting the bar 41 of the first locking mechanism element 28 into the channel 31 of the second locking mechanism element 30. The channel 31 may be made from a resilient or flexible material allowing the bar 41 of the first locking mechanism element 28 to be frictionally retained within the channel 31. In further embodiments, the first locking mechanism element 28 and second locking mechanism element 30 may be configured to be removably coupled together by being press fit or snap fit together. In alternative embodiments, a first locking mechanism element 28 and second locking mechanism element 30 may comprise one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function.

As perhaps best shown in FIGS. 1-6, 8-11, in some embodiments, the hair press 12 may comprise one or more, such as a plurality of, vents 42. In further embodiments, a vent 42 may extend through the first press member 16 including the first press surface 17. In still further embodiments, a vent 42 may extend through the second press member 18 including the second press surface 19. A vent 42 may allow air and moisture from damp hair to pass through the hair press 12 to facilitate drying of hair within the cavity 23 when the hair press 12 is in a closed position 70.

Figure 8:
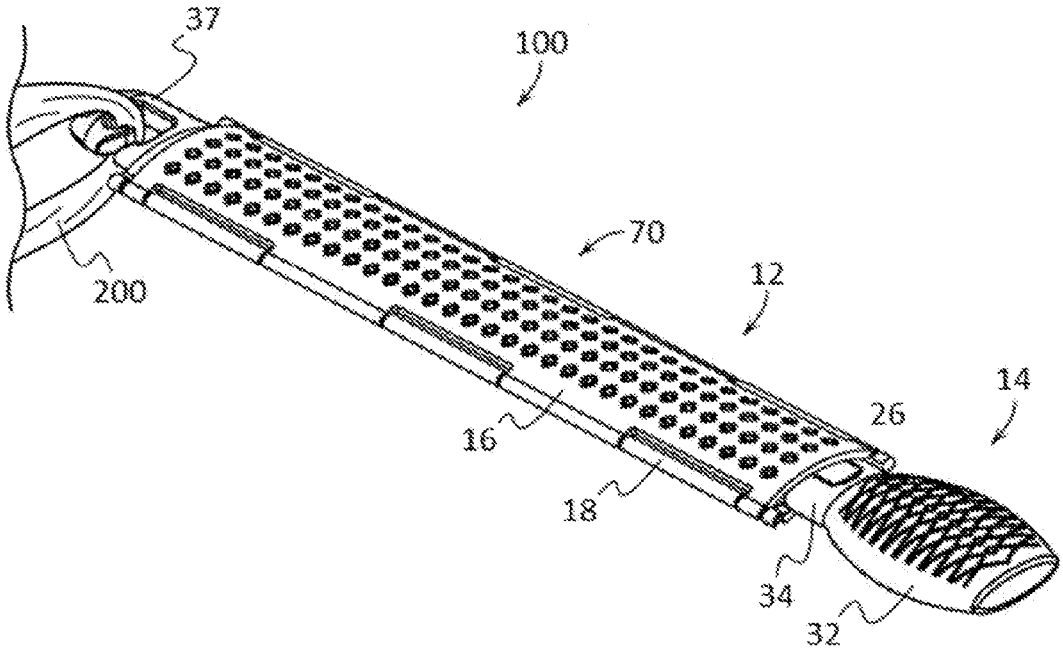
FIG. 8 illustrates a perspective view an example of an applicator of a hair straightening device engaged to hair according to various embodiments described herein.
Figure 9:
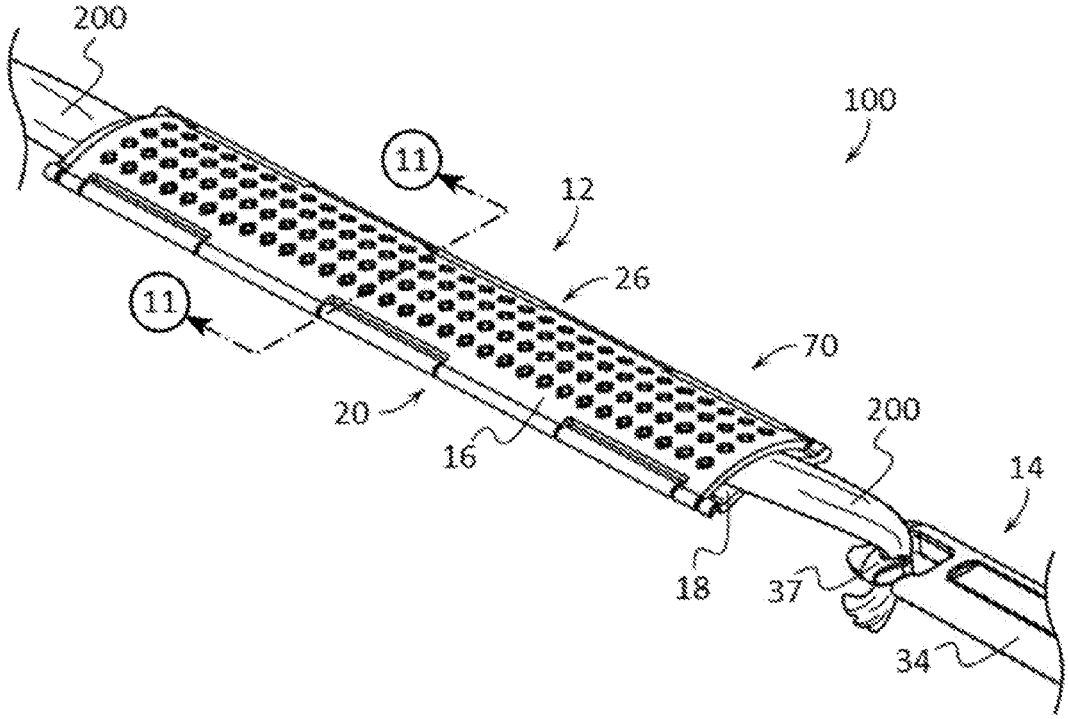
FIG. 9 shows a perspective view an example of an applicator and a hair press each engaged to hair according to various embodiments described herein.

In some embodiments, hair press 12 may include a first press member 16 and a second press member 18 which may both comprise a curved planar shape 44 (FIGS. 10 and 11) and which may both be formed from a rigid material. The first press surface 17 of the first press member 16 and the second press surface 19 of the second press member 18 may be formed from a resilient material such as, but not limited to, rubber and foam. The first press member 16 and second press member 18 may be connected by at least one hinge assembly 20 on each of the elongated sides 50, 52, 58, and 60. For example, a first hinge assembly 20 may be configured to pivotally couple the first elongated hinge side 58 of the first press member 16 to the second elongated hinge side 52 of the second press member 18 and a second hinge assembly 20 may be configured to pivotally couple the first elongated locking side 50 of the first press member 16 to the second elongated locking side 60 of the second press member 18. The first and second hinge assemblies 20 may use, but are not limited to springs, rubber or any other element that has the ability to store mechanical energy which may force the first press member 16 and the second press member 18 together, to create a downward compression force onto entrapped strand(s) of hair 200 (FIGS. 8, 9, and 11). In alternative embodiments, the first press surface 17 of the first press member 16 and the second press surface 19 of the second press member 18 may be formed from a resilient material such as, but not limited to, rubber, foam, or other elastomers which may also be used to form one or more hinge assemblies 20 which may force the first press member 16 and the second press member 18 together, to create a downward compression force onto entrapped strand(s) of hair 200 within the cavity 23.

Figure 7:
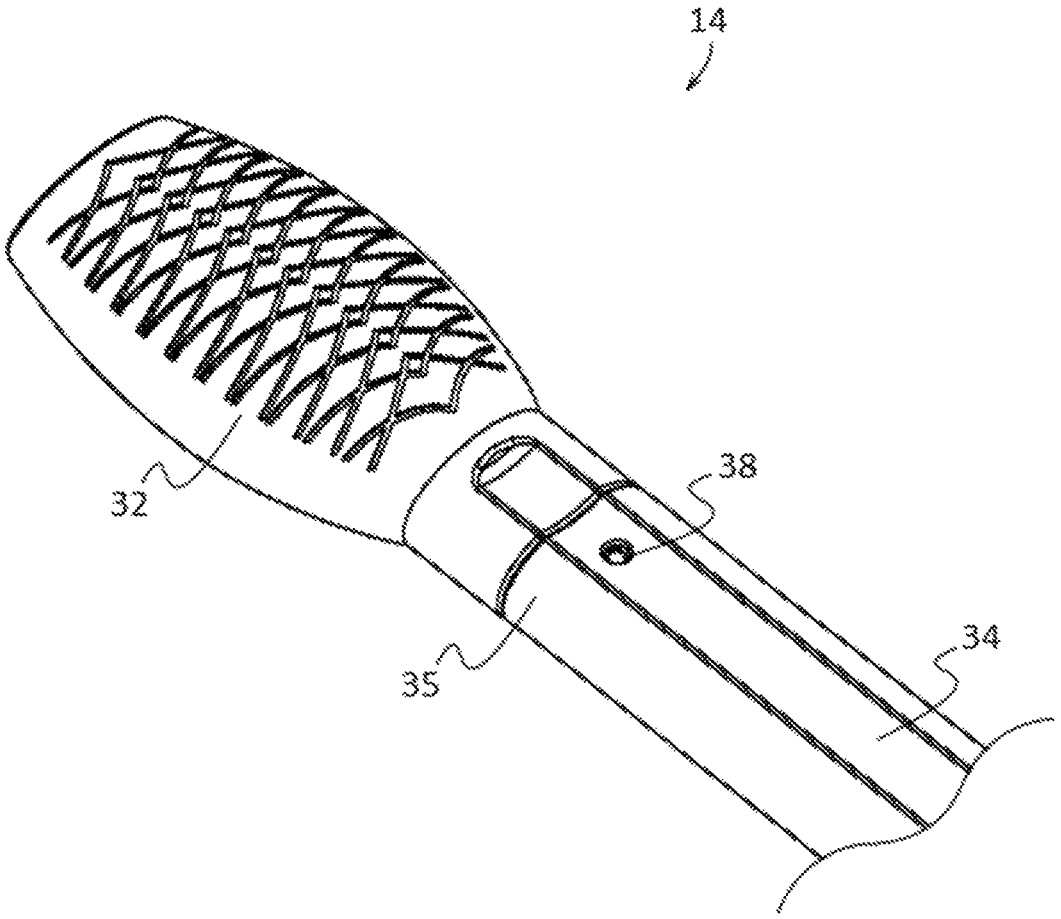
FIG. 7 depicts a partial perspective view of an example of an applicator of a hair straightening device according to various embodiments described herein.

Referring now to FIGS. 1, 2, 7-9, the applicator 14 may include a shaft 34 with a first end 36 and a second end 37. A handle 32 may be coupled to the first end 35 of the shaft 34, and a hair hook 37 may be coupled to the second end 37 of the shaft 34. In some embodiments, the handle 32 and/or the hair hook 37 may be removably coupled to the shaft 34 with a separation element 38. The separation element 38 may comprise a fastener, such as a ball and detent fastener, which may be used to couple and or uncouple the handle 32 and/or the hair hook 37 to the shaft 34. For example and as shown in the example of FIG. 7, the handle 32 may comprise a ball which may be received by a detent or aperture in the shaft 34. In alternative embodiments, a separation element 38 may comprise one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function.

In preferred embodiments, the shaft 34 may be longer than the hair press 12 and/or longer than the cavity 23, to allow the hair hook 37 to be fully exposed at one end formed by minor sides 54, 55, or minor sides 56, 57, when placed inside the cavity 23 of the hair press 12. The user can place the applicator 14 into the cavity 23, then secure a strand(s) of hair 200 (FIGS. 8, 9, 11) in the hair hook 37. The user pulls the handle 32, pulling the applicator 14 through the hair press 12, dragging the strand(s) of hair 200 into the cavity 23 where the hair is compressed between the press surfaces 17, 19. In further embodiments, the shaft 34 may have an arch shape that may be complementary to the curved planar shape 44 of a first press surface 17 and/or a second press surface 19 (FIGS. 10 and 11) and that may extend along the length of the shaft 34, from the hair hook 37 to the handle 32. A shaft 34 comprising an arch shape, allows the shaft 34 of the applicator 14 to be positioned flush with the curved planar shape 44 of a first press surface 17 and/or a second press surface 19.

In some embodiments, a hair hook 37 may be shaped or configured to hook or otherwise entrap a strand of hair 200 thereby allowing a user to manipulate and entrapped strand of hair 200. For example, the user may manipulate a strand of hair 200 entrapped by the hair hook 37 to pass the hair 200 through the cavity 23 of the hair press 12 and then release the hair 200 from the hair hook 37 after it has passed through the cavity 23. The hair hook 37 illustrated is exemplary in alternative embodiments, a hair hook 37 may be configured in a plurality of other shapes which may be suitable for selecting and entrapping one or more strands of hair 200 to allow a user to manipulate the hair 200.

FIGS. 8, 9, and 11 show an example method of using a hair straightening device 100 according to various embodiments. In some embodiments, the device 100 may be used to straighten hair which has been positioned within the cavity 23 of the hair press 12 and the method may begin by placing the applicator 14 within the cavity 23 of a hair press 12 in the closed position 70 with the hair hook 37 of the applicator 14 exposed on one end of the hair press 12, and the handle 32 exposed on the opposite end of the hair press 12. The user may then hook or otherwise entrap a strand of hair 200 preferably close to the scalp with the hair hook 37. Optionally, the user may pinch a lower portion of the strand(s) of hair 200 between two fingers and holding the device 100 in hand entrap one or more strands of hair 200 with the hair hook 37. The user may then use the handle 32 to pull the applicator 14 through the cavity 23 of the hair press 12 thereby bringing the entrapped strand(s) of hair 200 with it. As the strand(s) of hair 200 is being pulled into and through the cavity 23 by the applicator 14, tension will be exerted on the portion of the strand(s) of hair 20 within the cavity 23 between the first press surface 17 and the second press surface 19. As the applicator 14 is moved through the cavity 23, the press surfaces 17, 19, immediately collapse down onto each section of the strand(s) of hair 200 immediately following behind the hair hook 37 of the applicator 14 as it passes through the cavity 23 of the hair press 12. Entrapping the strand(s) of hair and applying a transverse compressive force sufficient enough to hold the strand(s) of hair 200 in a tension straightened position until dried. A user may use one or more hair presses 12 to straighten one or more strands of hair 200. When the strand(s) of hair dries or when otherwise desired, the hair press 12 may be removed from the strand of hair 200. In some embodiments, a hair press 12 comprising a locking assembly 26 on the elongated locking sides 50, 60, and a hinge assembly 20 on the elongated hinge sides 58, 52, may be removed by unlocking the locking mechanism assembly 26 and then uncoupling a first locking mechanism element 28 from a second locking mechanism element 30 and/or by pulling the hair 200 out of the cavity 23. In alternative embodiments, a hair press 12 comprising a hinge assembly 20 on the elongated locking sides 50, 60, and a hinge assembly 20 on the elongated hinge sides 58, 52, may be removed by optionally squeezing the two hinge assemblies together to relieve the compression and/or by pulling the hair 200 out of the cavity 23. Once the desired strand(s) of hair 200 have been removed from the desired hair presses 12 and the hair 200 has emerged from the hair press(s) 12 transformed into a temporary straightened pattern, the method may finish.

While some materials have been provided, in other embodiments, the elements that comprise the device 100 such as the first press member 16, second press member 18, press surfaces 17, 19, hinge assembly 20, optional locking assembly 26, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A hair straightening device, the device comprising:
an applicator including:
i. a shaft comprising a first end and a second end;
ii. a handle coupled to the first end of the shaft; and
iii. a hair hook coupled to the second end of the shaft;
a hair press including:
i. a first press member comprising a first press surface, a first elongated locking side, and a first elongated hinge side;
ii. a second press member comprising a second press surface having a curved planar shape for pressing the hair, a second elongated locking side, and a second elongated hinge side;
iii. a first hinge assembly configured to pivotally couple the first elongated hinge side of the first press member to the second elongated hinge side of the second press member; and
iv. a cavity formed between the first press surface and second press surface when the first press surface is moved proximate to the second press surface; and
the shaft of the applicator being longer than the cavity of the hair press and the shaft having an arch shape complementary to the curved planar shape of the second press surface.

2. The device of claim 1, further comprising a second hinge assembly configured to pivotally couple the first elongated locking side of the first press member to the second elongated locking side of the second press member.

3. The device of claim 1, wherein the cavity is configured to slidably receive the shaft and hair hook.

4. The device of claim 1, wherein the hinge assembly comprises a male pin received by both a first female aperture at a first end of the hinge assembly and a second female aperture at a second end of the hinge assembly, and wherein the male pin is configured to pivot within the female apertures.

5. The device of claim 1, further comprising a locking assembly configured to removably couple the first elongated locking side to the second elongated locking side.

6. The device of claim 5, wherein the locking assembly comprises a first locking mechanism element and a second locking mechanism element having a channel, and wherein the first locking mechanism element and the second locking mechanism element are configured to be removably coupled together by inserting the first locking mechanism element into the channel of the second locking mechanism element.

7. The device of claim 1, wherein the first press member and second press member each comprise a vent.

8. The device of claim 1, wherein the first press member and second press member are formed from a resilient material.

9. The device of claim 1, wherein first press surface and the second press surface are formed from a resilient material.

10. The device of claim 1, wherein first press surface comprises a curved planar shape and the second press surface's curved planar shape is complementary to the curved planar shape of the first press surface.

11. A hair straightening device, the device comprising:
an applicator including:
i. a shaft comprising a first end and a second end;

ii. a handle coupled to the first end of the shaft; and iii. a hair hook coupled to the second end of the shaft; and a hair press including:

i. a first press member comprising a first press surface, a first elongated locking side, a first elongated hinge side, a first proximal minor side, and a first distal minor side;

ii. a second press member comprising a second press surface with a curved planar shape for pressing the hair, a second elongated locking side, a second elongated hinge side, a second proximal minor side, and a second distal minor side;

iii. a locking assembly configured to removably couple the first elongated locking side to the second elongated locking side;

iv. a hinge assembly configured to pivotally couple the first elongated hinge side of the first press member to the second elongated hinge side of the second press member;

v. a cavity extending from the first and second proximal minor sides to the first and second distal minor sides, wherein the cavity is formed between the first press surface and second press surface when the first elongated locking side is removably coupled to the second elongated locking side, and wherein the cavity is configured to slidably receive the shaft and hair hook; and vi. the shaft of the applicator being longer than the cavity of the hair press and the shaft having an arch shave complementary to the curved planar shape of the second press surface.

12. The device of claim 11, wherein the hinge assembly comprises a male pin received by a female aperture, and wherein the male pin is configured to pivot within the female aperture.

13. The device of claim 12, wherein the locking assembly comprises a first locking mechanism element and a second locking mechanism element having a channel, and wherein the first locking mechanism element and the second locking mechanism element are configured to be removably coupled together by inserting the first locking mechanism element into the channel of the second locking mechanism element.

14. The device of claim 13, wherein the first locking mechanism element and second locking mechanism element are configured to be removably coupled together by being press fit together.

15. The device of claim 12, wherein the first press member and second press member each comprise a vent.

16. The device of claim 12, wherein the first press member and second press member are formed from a resilient material.

17. The device of claim 12, wherein first press surface and the second press surface are formed from a resilient material.

18. The device of claim 12, wherein first press surface comprises a curved planar shape and the second press surface's curved planar shape is complementary to the curved planar shape of the first press surface.

* * * * *